US005349143A

United States Patent [19]

Houser

[11] Patent Number: 5,349,143

[45] Date of Patent: Sep. 20, 1994

[54] REVERSIBLE ELECTRICAL SWITCH

[75] Inventor: John M. Houser, Stow, Ohio

[73] Assignee: Lucerne Products, Inc., Hudson, Ohio

[21] Appl. No.: 5,618

[22] Filed: Jan. 19, 1993

[51] Int. Cl.[5] ..... H01H 1/12; H01H 19/54; H01H 21/76

[52] U.S. Cl. ..... 200/11 J; 200/1 V; 200/11 K

[58] Field of Search ..... 200/11 R, 11 J, 11 K, 200/1 V, 252, 257, 260, 261, 273, 290, 291, 570, 571, 8 R, 8 A

[56] References Cited

U.S. PATENT DOCUMENTS 3,637,967 1/1972 Braun ..... 200/1 V X
4,864,083 9/1989 Bittel ..... 200/1 V

*Primary Examiner*—J. R. Scott

*Attorney, Agent, or Firm*—Renner, Kenner, Greive, Bobak, Taylor & Weber

[57] ABSTRACT

A reversible electric switch has movable contacts on opposite ends of a rotor adapted for interengagement with diametrically disposed pairs of stationary contacts. Intermittency or rocking of the movable contacts with respect to the stationary contacts is eliminated by extending drive pins from the rotor into the slot provided within the contact face of the movable contact, such pins passing only partially through the thickness of such contact face. Accordingly, the force applied to the movable contacts to achieve rotation thereof is substantially at the interface between the stationary and movable contacts, substantially eliminating any force couple or moment thus precluding any rocking of the movable contact upon the rotor or other relative movement between the two.

13 Claims, 2 Drawing Sheets

REVERSIBLE ELECTRICAL SWITCH

TECHNICAL FIELD

The invention herein resides in the art of electrical switches and, more particularly, to rotary switches of the reversing type. Specifically, the invention relates to a reversible rotary switch in which a movable contact is substantially fixed to and immobile with respect to a rotor member.

BACKGROUND ART

The invention herein relates particularly to improvements in rotary electrical switches and particularly of the type set forth in U.S. Pat. No. 4,864,083 assigned to Lucerne Products, Inc., the assignee of the instant application. That patent teaches a particular reversible rotary switch of the type under consideration herein. It has been found that reversing switches of the type known in such prior art often demonstrate an intermittency in the switching operation, characterized by unwanted making and breaking of the contacts. It has been found that rocking or otherwise manipulating the reverse lever of the switch may cause such intermittent operation. Upon inspection, it was found that the forces applied to the moving contacts of the reversing switch cause a rocking motion to occur rather than a pure sliding motion of the movable contacts over the stationary contacts.

An appreciation of the problems encountered in the prior art may be obtained by reference to the prior art switch of FIG. 1. There, a reversing switch according to the prior art is designated generally by the numeral 10. Switch 10 includes a rotor 12 adapted for rotation about an axis 14 by actuation of a reversing lever 16, shown only illustratively. For a complete understanding of the operation of the switching mechanism, reference need simply be made to prior U.S. Pat. No. 4,864,083.

Maintained as a portion of the reversing switch 10 is a first pair of stationary contacts 18 and a second pair of stationary contacts 20. As shown in FIG. 1, the contacts of the pair 18 are diametrically opposed from each other, as are the contacts of the pair 20. The diametric opposition is taken with respect to the rotational axis 14. Received upon the diametrically opposed ends of the rotor 12 are a pair of movable contacts 22. Those skilled in the art will readily appreciate that the movable contacts 22 are typically U-shaped and are slidingly received upon the opposite ends of the rotor 12 in recesses 28 provided for such purpose.

Springs 24 are provided in appropriate pockets or bores 26 in the rotor 12, such springs 24 biasing the respective movable contacts 22 axially from the rotational axis 14 to urge the movable contacts 22 toward the stationary contacts 18, 20. It will be readily appreciated by those skilled in the art that springs 14 contact a portion of the rotor 12 at one end thereof and extend outwardly therefrom and into contact with an associated movable contact 22 at the other end.

The operation of the reversing switch 10 is fully set forth in U.S. Pat. No. 4,864,083. Suffice it to say that a reversing lever 16 is operative to rotate the rotor 12 about the axis 14 to bring the movable contacts 22 into interconnecting engagement with selected ones of the pairs of stationary contacts 18, 20. The rotor 20 is adapted for reciprocating movement between the pairs of contacts such that in one position standard or forward operation of the associated motor is attained, while in the opposite position, reverse operation of the motor is attained. It is, of course, contemplated that the movable contacts 22 may also be positioned intermediate the positions just stated, such that the movable contacts 22 engage only the stationary contacts 18. Such position is typically a neutral or locked position. Again, those skilled in the art will appreciate that the rotational movement of the rotor 12 is achieved by movement of a reversing lever keyed thereto as at 16.

In the desired standard operation of the switch 10, it is contemplated that the movable contacts 22 will smoothly slide upon the stationary contacts 18, 20 and that the movable contacts 22 will stay longitudinally aligned upon the rotor 12. Consequently, each of the movable contacts 22 will be in constant contacting engagement with diametrically opposed pairs of the pairs of contacts 18, 20 or in the neutral position, in engagement with only the stationary contacts 18. However, it has been found that such consistent contacting engagement is not always attained in the prior art structure.

With continued reference to FIG. 1, it can be seen that a counterclockwise motion of the rotor 12 has been commenced by movement of the reversing lever 16, as designated by the rotational arrow 30. As shown in FIG. 1, the lower movable contact 22 stays in sliding engagement with the stationary contacts 18, 20, while the upper movable contact 22 has rocked from its longitudinal alignment upon the rotor 12 and, while remaining in engagement with the stationary contact 18, has rocked away from the stationary contact 20, providing a gap 38 therebetween. The gap 38 is developed because the frictional engagement between the associated movable contact 22 and stationary contact 18 is not overcome by the rotational force provided to the rotor 12 and because the force to rock the contact 22 from alignment with the rotor 12 is less than the force of such frictional engagement.

As shown in FIG. 1, a force 32 is provided to the rotor 12 by means of the reversing lever 16. An opposite frictional force 34 is developed at the interface between the contacts 22, 18, as shown. The forces 32, 34 are separated by a distant d designated by 36. Accordingly, a force couple is generated on the associated moving contact 22, causing the same to rotate as shown in FIG. 1, become misaligned upon the rotor 12, and generating the gap 38. In other words, the moment or force couple generated by the forces 32, 34 separated by the distance 36, causes the rotational movement of the movable contact 22 and the resultant gap 38, accounting for the undesired intermittency of operation.

The happenstance of the intermittence just discussed is a function of the spring constant of the associated springs 24 and the coefficient of friction at the interface between the associated movable contact 22 and the stationary contact 18. Since the static coefficient of friction is generally greater than the dynamic coefficient of friction, typically the static coefficient of friction is of primary concern.

Since it appears that a frictional engagement between the stationary and contact and moving contact develops the moment or force couple which rocks the movable contacts and causes the intermittence of operation, it is desirable to minimize or eliminate the force couple. Since a moment or force couple is the product of force and distance, either the force or the distance must be minimized or substantially eliminated to achieve the desired object. Since the frictional force is a function of the normal force at the interface and the characteristic coefficient of friction, the frictional force can be reduced only by reducing the normal force. However, the normal force is that imparted by the springs 24, which also provide for assurance of positive engagement between the movable and stationary contacts, while also assuring the necessary current conducting capacity. Accordingly, it is not desirable to alter or reduce the spring force of the reversing switch 10.

Absent a means for reducing the frictional interference between the moving and stationary contacts and/or the resultant force couple, complex and expensive manufacturing, sorting, and testing procedures have been found to be necessary to minimize the intermittent problem. Not only is it desirable to eliminate such procedures, but it is also desirable to provide for a means for eliminating the intermittency problem with a switch design which may be easily manufactured.

DISCLOSURE OF INVENTION

In light of the foregoing, it is a first aspect of the invention to provide a reversible electric switch which has increased reliability by eliminating a tendency for the moving contacts to momentarily break engagement with the stationary contacts under certain conditions.

Another aspect of the invention is the provision of a reversible electric switch which may be made of components having tolerances which are conducive to ease of manufacture.

Still a further aspect of the invention is the provision of a reversible electric switch in which expensive manufacturing, sorting, and testing procedures may be substantially eliminated, while assuring elimination of intermittent making and breaking of the contact interfaces.

Another aspect of the invention is the provision of a reversible electric switch which may be readily constructed with state of the art elements and techniques.

Yet an additional aspect of the invention is the provision of a reversible electric switch which is reliable and durable in operation.

The foregoing and other aspects of the invention which is will become apparent as the detailed description proceeds are achieved by a switch, comprising: a pair of stationary contacts; a rotor in juxtaposition to said pair of stationary contacts; a moving contact maintained upon an end of said rotor, rotational movement of said rotor engaging a face of said moving contact with said pair of stationary contacts; and drive means interengaging said moving contact and said rotor for maintaining uniform movement of said moving contact with respect to said rotor and preventing relative movement therebetween when said face of said moving contact engages said pair of stationary contacts.

Other aspects of the invention which will become apparent herein are attained by a switch, comprising: first and second stationary contacts; a rotor reciprocatingly maintained between said stationary contacts; a U-shaped contact received on an end of said rotor, said U-shaped contact having an arcuate member between two legs; spring means interposed between said rotor and U-shaped contact for urging said U-shaped contact into engagement with said stationary contacts; and drive means interengaging said rotor and U-shaped contact for inhibiting relative movement between said U-shaped contact and said rotor when said rotor moves said U-shaped member across said stationary contacts.

DESCRIPTION OF DRAWINGS

For a complete understanding of the objects, techniques, and structure of the invention reference should be made to the following detailed description and accompanying drawings wherein.

BEST MODE FOR CARRYING OUT THE INVENTION

Figure 1:
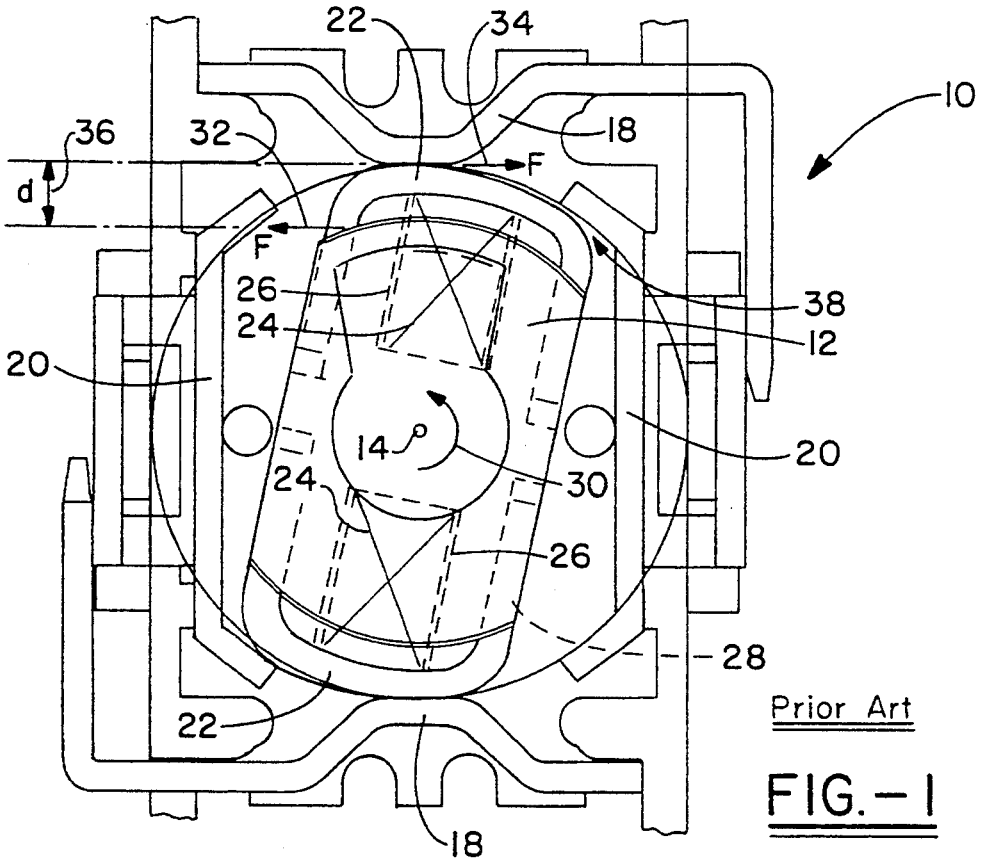
Prior Art FIG.-1
FIG. 1 is an illustrative top plan view of a reversing switch according to the prior art.

Since the intermittency problem discussed above is a result of a force couple and the force component of that force couple or moment cannot be substantially changed, the invention herein focuses upon a substantial reduction of the distance between the forces generating the couple. If the distance d designated by the numeral 36 in FIG. 1, can be reduced to zero, the force couple will be eliminated and the intermittence problem resolved. Accordingly, if the force driving the movable contact 32 is placed at the interface between the movable and stationary contacts, the distance d will be reduced to zero and the force couple eliminated. Consequently, the focus of the invention is upon moving the driving force for the movable contact 22 close to the outer contact surface thereof so as to minimize the distance d and, accordingly, the force couple.

Figure 2:
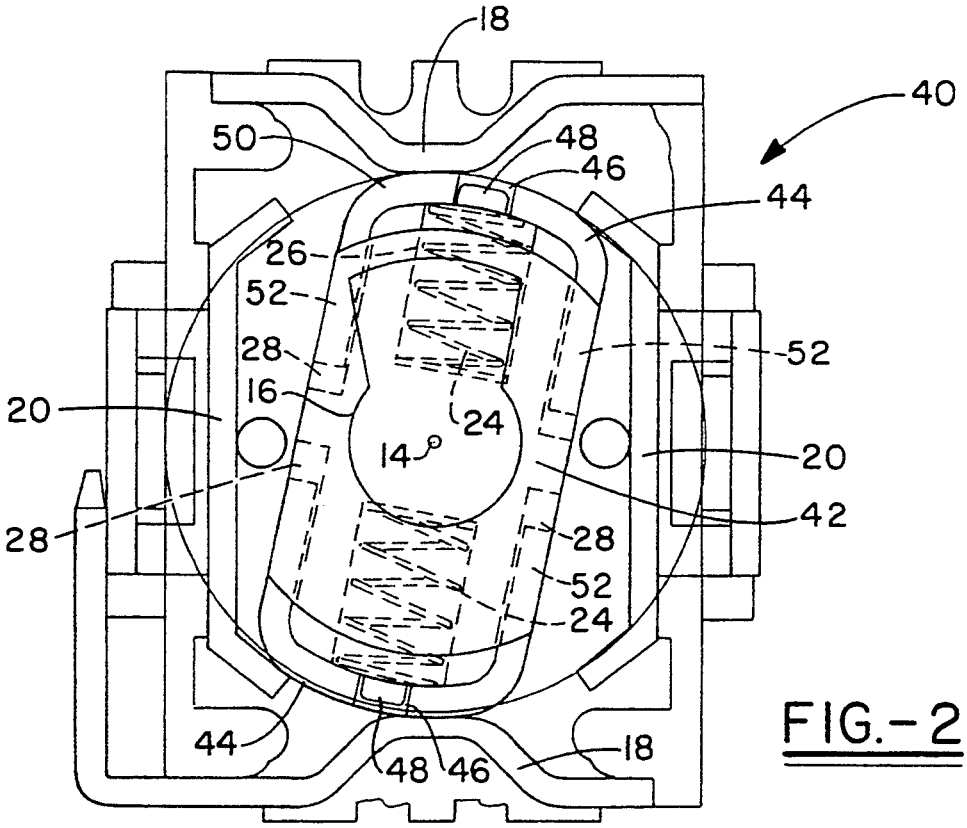
FIG. 2 is an illustrative top plan view of a reversing switch according to the invention.
Figure 3:
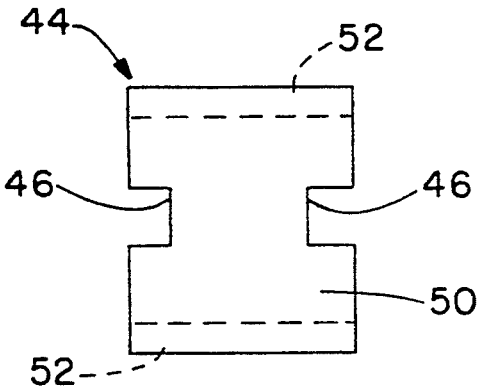
FIG. 3 is a top plan view of a movable contact according to the invention.
Figure 4:
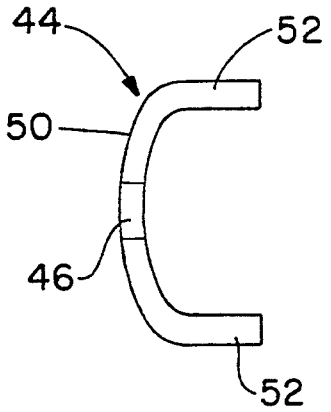
FIG. 4 is a side elevational view of the moving contact of FIG. 3.

With reference now to FIG. 2, it can be seen that a reversing switch according to the invention is designated generally by the numeral 40. Again, stationary contact pairs 18, 20 are diametrically opposed with respect to the rotational axis 14 and uniformly spaced thereabout. The rotor 42 rotates about the axis 14 and carries movable contacts 44 thereon, again received in the slots 28 as in the prior art. However, as shown in FIGS. 2–4, the movable contact 44 is provided with a pair of slots 46 on opposite sides of the center line of the arcuate end surface 50. Of course, the arcuate end surface 50 is that surface having a face thereon adapted for engagement with the stationary contacts 18, 20.

Figure 5:
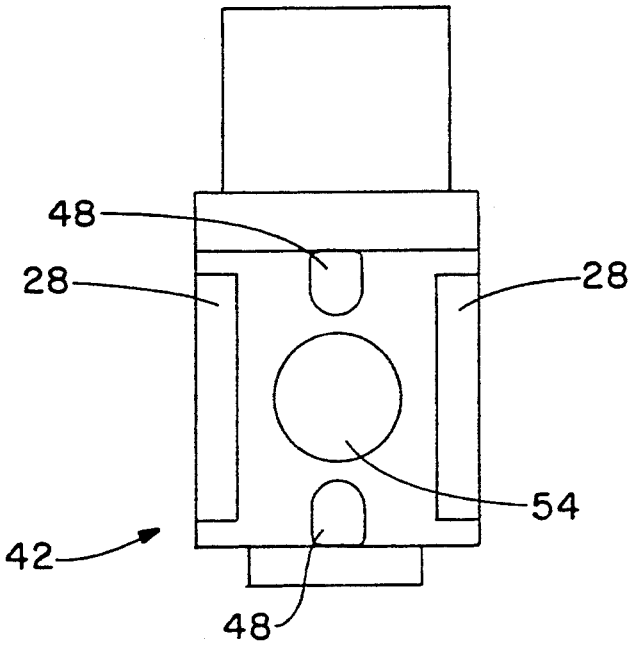
FIG. 5 is a top plan view of the rotor of the reversible switch of the invention.

The rotor 42 of the instant invention is also provide with a pair of drive pins 48 which extend upwardly into and are received by the pair of slots 46 when the legs 52 of the movable contact 44 are received in the slide recesses 28, as shown in FIGS. 2 and 5. The drive pins 48 are such that they do not extend through the slots 46 from one side of the arcuate face 50 to the other, but are retained within the thickness thereof. Accordingly, when the arcuate face 50 wipes across the surfaces of the stationary contacts 18, 20, the drive pins 48 do not interfere with such wiping motion. Of course, as with the prior art, the springs 24 are received within associated pockets or bores 26 and extend outwardly through apertures 54, as shown in FIG. 5, to urge against the bottom surface of the arcuate contact face 50. As in standard fashion, the springs 24 urge the movable contacts 44 toward the stationary contacts 18, 20 with the legs 52 slidingly received within the slide recesses 28.

With the structure just described, rotational movement of the rotor 42 as by actuation of the reversing lever 16 causes the force upon the movable contacts 44 to be imparted by the drive pins 48 into the body of the arcuate contact surface 50 as drive pins 48 engage the edges of the associated slots 46. Accordingly, the distance d between the driving force and the frictional force is significantly minimized so that any resultant couple is also minimized and insufficient to rock the movable contact 44 from the associated stationary contacts 18, 20. Accordingly, the intermittency problem is eliminated.

It can now be appreciated that the concept of the invention is to simply modify the movable contacts such that forceful engagement between the rotor and the contacts is within the arcuate contact surfaces of the movable contacts and in close proximity to the interface between the movable and stationary contacts. In the preferred embodiment, the slots 46 and drive pins 48 loosely engage, allowing the movable contacts 44 to self align upon the rotor 42 and within the slide recesses 28. With the moving force applied to the movable contacts 44 being substantially tangential to the contact interface, the force couple is substantially eliminated and the self aligned movable contact attains reliable engagement with the stationary contact under the same engaging spring force as in the prior art. Accordingly, current carrying capabilities are maintained while intermittency of operation is eliminated.

It will further be readily appreciated that a portion of the concept of the invention is to provide an interengagement between the moving contacts and the associated rotor which assures that the contacts move with the rotor, but that relative movement, such as rocking or the like, between the rotor and the movable contacts is substantially eliminated. Again, such occurs by providing the rotational driving force on the movable contacts at or near the engagement interface between the stationary and movable contacts.

Thus it can be seen that the objects of the invention have been satisfied by the structure presented above. While in accordance with the patent statutes only the best mode and preferred embodiment of the invention has been presented and described in detail, it is to be understood that the invention is not limited thereto or thereby. Accordingly, for an appreciation of the true scope and breadth of the invention reference should be made to the following claims.

What is claimed is:

1. A switch, comprising:

a pair of stationary contacts;

a rotor in juxtaposition to said pair of stationary contacts;

a moving contact maintained upon an end of said rotor, rotational movement of said rotor engaging a face of said moving contact with said pair of stationary contacts; and drive means interengaging said moving contact and said rotor for maintaining uniform movement of said moving contact with respect to said rotor and preventing relative movement therebetween when said face of said moving contact engages said pair of stationary contacts, said drive means comprising protrusions extending from said rotor and receptacles within said moving contact receiving said protrusions.

2. The switch according to claim 1, wherein said face of said moving contact is arcuate and said drive means engages said moving contact along a centerline of said arcuate face.

3. The switch according to claim 2, wherein said drive means interengages said moving contact and said rotor within a thickness of said arcuate face.

4. A switch, comprising:

first and second stationary contacts;

a rotor reciprocatingly maintained between said stationary contacts;

a U-shaped contact received on an end of said rotor, said U-shaped contact having an arcuate member between two legs;

springs means interposed between said rotor and U-shaped contact for urging said U-shaped contact into engagement with said stationary contacts; and drive means interengaging said rotor and U-shaped contact for inhibiting relative movement between said U-shaped contact and said rotor when said rotor moves said U-shaped member across said stationary contacts, said drive means comprising a pair of slots on opposite sides of said arcuate member and a pair of pins extending from said rotor, said pins mating with said slots.

5. The switch according to claim 4, wherein said protrusions comprise a pair of drive pins.

6. The switch according to claim 5, wherein said receptacle comprises a slot in sides of said arcuate face, said slots receiving said drive pins.

7. The switch according to claim 6, wherein said slots are in opposite side edges of said arcuate face and on the centerline thereof.

8. The switch according to claim 7, wherein said drive pins extend in said slots only partially through said thickness of said arcuate face.

9. The switch according to claim 9, wherein said drive pins and said slots are loosely interengaged, allowing said rotor and moving contact to align with each other.

10. The switch according to claim 4, wherein said pins extend only partially through a thickness of said arcuate member.

11. The switch according to claim 10, wherein said slots lie on a centerline of said arcuate member.

12. The switch according to claim 14, wherein said slots are provided in side edges of said arcuate member.

13. The switch according to claim 12, wherein said slots and pins engage with a tolerance allowing said U-shaped contact and rotor to align.

* * * * *